US007260925B2

(12) United States Patent
Montini et al.

(10) Patent No.: US 7,260,925 B2
(45) Date of Patent: Aug. 28, 2007

(54) YARNS AND FABRICS SUITED FOR THE SHIELDING, BY REFLECTANCE, OF ELECTROMAGNETIC WEAVES

(75) Inventors: Leonardo Montini, Prato (IT); Francesco De Cavi, Via Flaminia, 670-00191 Roma (IT)

(73) Assignees: EOS S.r.l., Concorezzo (IT); Protech 1 S.r.l., Montemurlo (IT); Francesco De Cavi, Rome (IT)

( * ) Notice: Subject to any disclaimer, the term of this patent is extended or adjusted under 35 U.S.C. 154(b) by 0 days.

(21) Appl. No.: 10/516,906

(22) PCT Filed: Jun. 2, 2003

(86) PCT No.: PCT/EP03/05744

§ 371 (c)(1),
(2), (4) Date: Dec. 2, 2004

(87) PCT Pub. No.: WO03/102279

PCT Pub. Date: Dec. 11, 2003

(65) Prior Publication Data

US 2005/0229579 A1 Oct. 20, 2005

(30) Foreign Application Priority Data

Jun. 4, 2002 (IT) ..... FI2002A0092

(51) Int. Cl.
*D02G 3/04* (2006.01)

(52) U.S. Cl. ..... 57/252

(58) Field of Classification Search ..... 57/252–257
See application file for complete search history.

(56) References Cited

U.S. PATENT DOCUMENTS

| | | | | |
|---|---|---|---|---|
| 3,987,613 | A * | 10/1976 | Woods et al. | 27/256 |
| 4,064,305 | A | 12/1977 | Wallin | |
| 4,771,596 | A * | 9/1988 | Klein | 57/2 |
| 5,313,774 | A * | 5/1994 | Matsumoto et al. | 57/255 |
| 2002/0136859 | A1 * | 9/2002 | Fisher et al. | 428/95 |

FOREIGN PATENT DOCUMENTS

| | | | |
|---|---|---|---|
| DE | 3820127 | A1 | 12/1989 |
| EP | 0 290 977 | A1 | 11/1988 |
| EP | 0 383 059 | A1 | 8/1990 |

* cited by examiner

*Primary Examiner*—Shaun R. Hurley
(74) *Attorney, Agent, or Firm*—Reising Ethington Barnes Kisselle, P.C.

(57) ABSTRACT

Yarn is disclosed including textile fibers and metallic fibers. The textile fibers are either natural or artificial fibers. The cut length of the textile fibers is between 50 and 100 millimeters. The metallic fibers are fabricated from Group VIII metals or their alloys. In addition, the metallic fibers have a cut length measuring between 20 and 80 millimeters.

10 Claims, 3 Drawing Sheets

YARNS AND FABRICS SUITED FOR THE SHIELDING, BY REFLECTANCE, OF ELECTROMAGNETIC WEAVES

FIELD OF THE INVENTION

The present invention relates to fabrics and yarns having reflectance characteristics on electromagnetic weaves; therefore they are useful both for the protection of people and objects exposed to electromagnetic fields, and for the location of people or objects covered by or manufactured with these fabrics.

STATE OF THE ART

As known in the art, a very important problem in the environmental protection field is the shielding against electromagnetic radiation; in fact its effect, for example on human health, even if still not totally proven, does not seem to be negligible.

Many kinds of fabrics have been described in literature, usually comprising metallic threads (disposed randomly in the fabric or forming its weave or warp) the use of which is recommended as shielding agents against electromagnetic weaves, thanks to the so-called "Faraday effect" they present. However, despite the many solutions presented, until now none of them can be applied without grounding, and therefore they don't result to be convenient while, when they can be used without grounding, they do not reach effective results. It is therefore clear the need to develop new materials that allow to reach an effective shielding of electromagnetic weaves, centering the research on properties and principles different from the ones used to this end up to now.

SUMMARY OF THE INVENTION

The present invention relates to yarns consisting of metallic and textile fibres, both natural and artificial, and fabrics consisting, both in their weave and warp, the said yarns manufactured according to the usual textile techniques used for obtaining various types of fabrics.

DETAILED DESCRIPTION OF THE INVENTION

Figure 1:
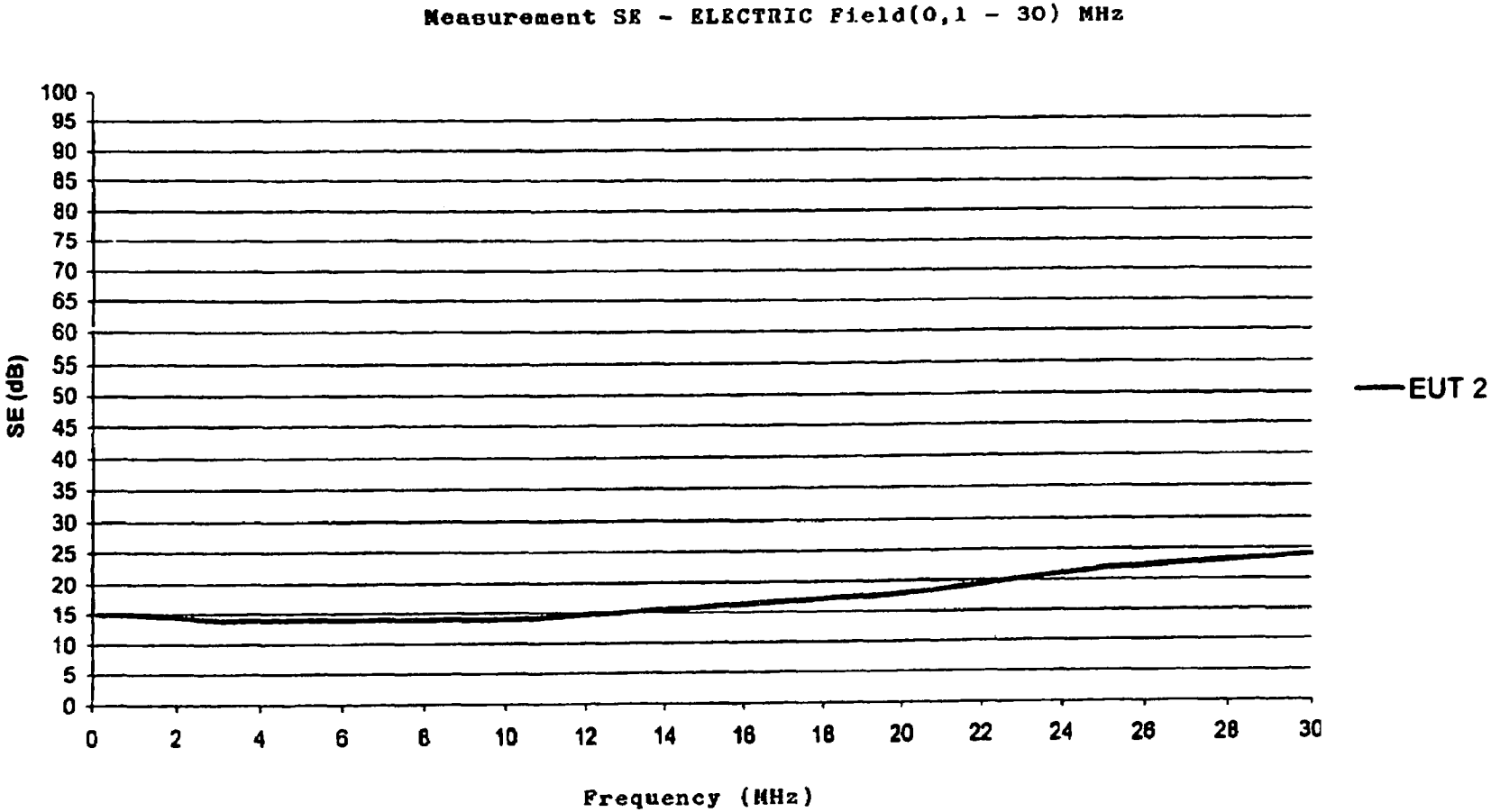
FIGS. 1-3 report, in the ordinate, the shielding effectiveness (SE) measured in decibels (dB), and, in the abscissas, the electromagnetic radiation frequency measured in Mega Hertz (MHz) or Giga Hertz (GHz).
Figure 2:
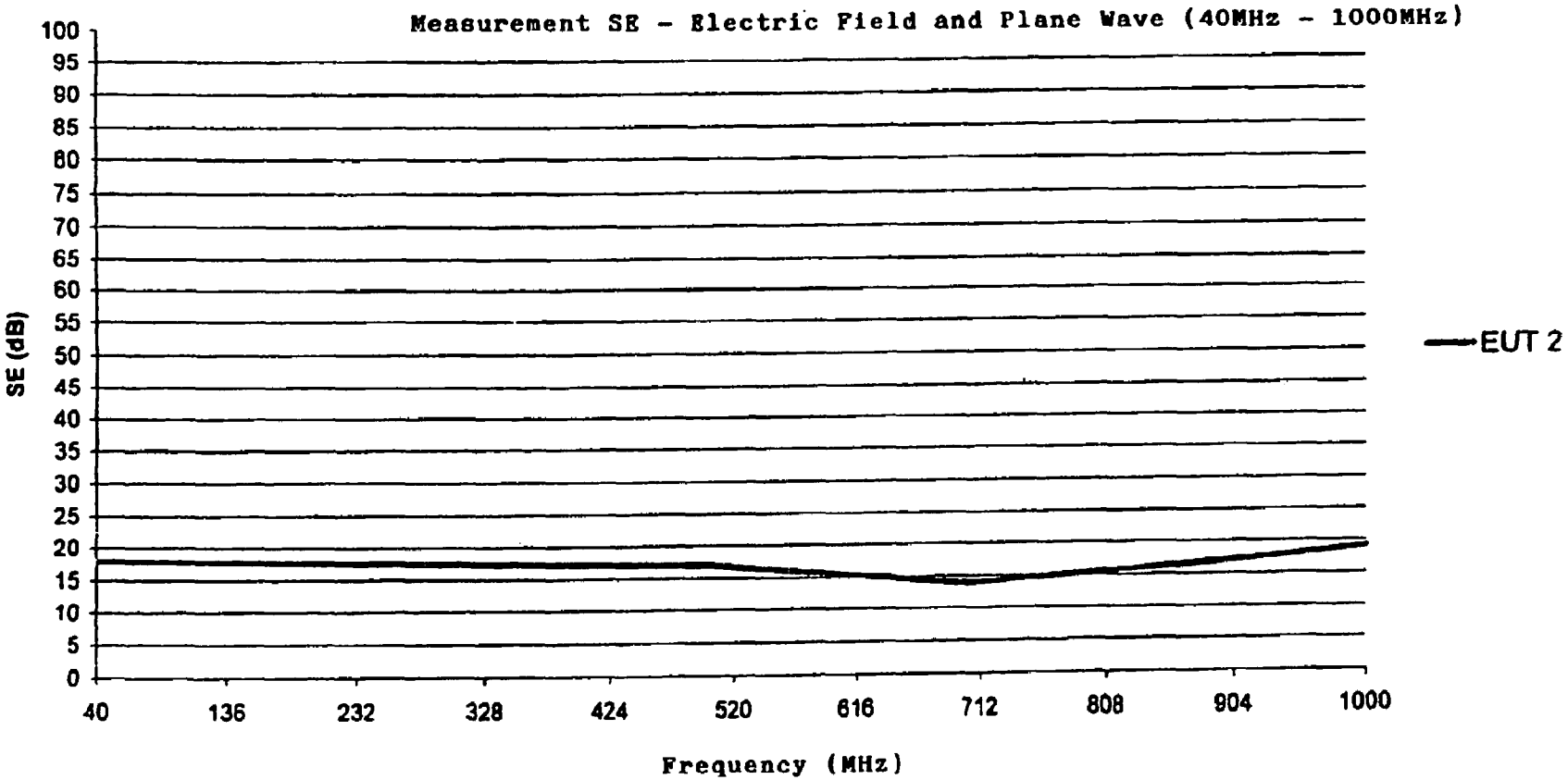
Figure 3:
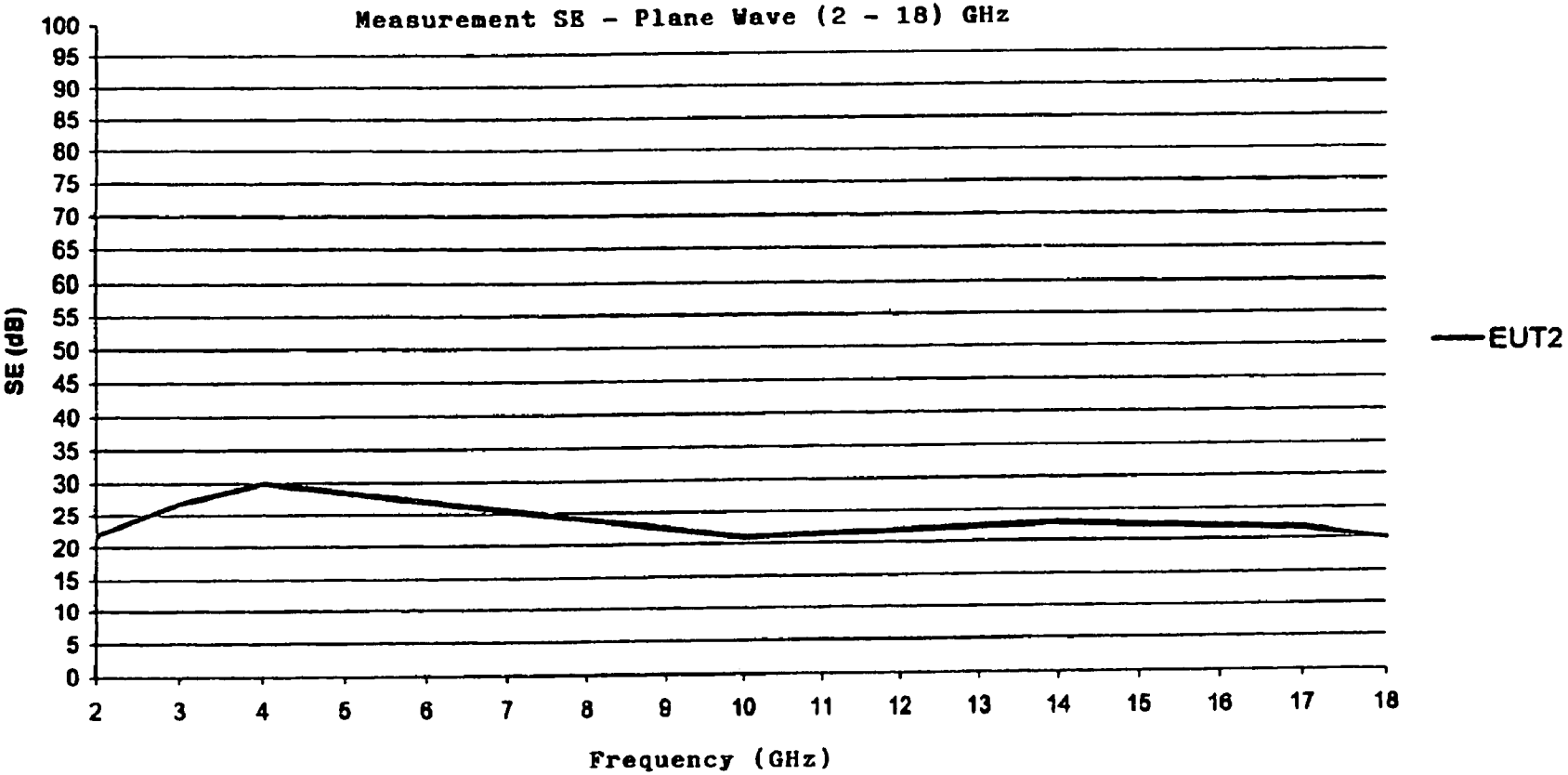

The present invention allows to overcome the above mentioned problems, thanks to yarns and fabrics consisting of fibres as defined above.

According to the present invention, with metallic fibres we mean metallic filaments, whereas with textile fibres we mean any kind of natural or artificial fiber used in the textile field.

Preferably the metallic fibres as defined above are fabricated from any one of the Group VIII metals of the Periodic Table, or their alloys, more preferably iron or its alloys.

The metallic fibres forming the yarns according to the present invention have a cut (length) measuring preferably between 20 and 80 mm (more preferably between 30 and 60 mm) whereas the textile fibres, either natural or artificial, have a cut measuring preferably between 50 and 100 mm, more preferably between 60 and 80 mm.

The cross-sectional diameter of the metallic fibres measures preferably between 0.1 and 1 mm, while the textile fibres one measures between 0.1 and 2 mm.

The flocks of metallic and textile fibres are combined and spun according to the traditional techniques, i.e. adopting the usual, appropriate expedients (for example during the hackling phase) requested by the presence of metallic fibres, the so obtained thread present therefore the metallic fibres mixed with the textile ones.

Preferably a thread according to the present invention comprises between 2 and 15% (in weight) in metallic fibres and 98-85% (in weight) in textile fibres.

The thread so obtained (either bare or, if necessary, twisted with equivalent threads, or with traditional, natural or artificial textile fiber threads) is then woven using the usual weaving techniques according to the type of the definitive fabric desired.

The fabric according to the present invention therefore comprises both in its weave and in its warp only threads according to the present invention, as above described. Preferably the distance between the threads (both in the weave and in the warp) measures between 0.1 and 3 mm.

The fabrics according to the present invention allow an exceptional protection against the propagation of electromagnetic energy, thanks to the fact that the shielding takes place by reflectance of the electromagnetic weaves and not by "Faraday effect" as is the fabrics described in the state of the art; therefore, in its shielding function this system does not need to be grounded.

The cross-sectional diameter of the metallic fibres measures preferably between 0.1 and 1 mm, while the textile fibres one measures between 0.1 and 2 mm.

The fabrics according to the present invention are therefore suitable for the manufacturing of goods for the decoration of rooms (as for example curtains, wall boards, wallpaper and upholstery, etc.) or for clothing (for example protective and safety clothes) for the protection against electromagnetic pollution.

In addition to their protective effect against electromagnetic pollution, as above mentioned, the fact that the fabrics manufactured according to the present invention have the characteristic of reflecting the electromagnetic weaves allows to use these fabrics also for the location (for example through radar exploration) of objects or people manufactured in, or covered by, these same fabrics; in this connection it should be noted that the fabrics according to the present invention preserve their characteristics also when they are wet: this makes them especially useful for covering objects to be used in water (buoys, lifeboats, life jackets and similar equipment) and which could require location in zero or poor visibility.

Obviously, the fabrics according to the present invention can be coupled to traditional fabrics or to other materials through the usual fixing systems (for example seams, sizing, buttons, clips, "Velcro", etc.)

EXPERIMENTAL DATA

A fabric according to the present invention, comprising polyester fibres (90%) and stainless steel fibres (10%) has been subjected to some measurements aimed at characterising its shielding effectiveness (SE).

In particular, to execute the necessary measurements according to the MIL STD-285 (Ed. 1956) reference regulations we used the SEMS (Shielding Effectiveness Measuring System), a small shielded room, measuring 1000×920×1100 8 h mm, in soldered steel plate having a 12 mm thickness.

At the center of its rear side there is a 400×600 mm opening for the tests.

The closing panel and the frame used for the tests are in 10 mm thick aluminum.

The material examined acts as closing panel of the room's opening, while the signal is transmitted by an external antenna to the SEMS, and is received there by an internal antenna.

The test results have been reported in the three graphs here enclosed, in which we reported in the ordinate the shielding effectiveness (SE) measured in decibels (dB), and in the abscissas the electromagnetic radiation frequency measured in Mega Hertz (MHz) or Giga Hertz (GHz).

As can be seen in the three graphs, in a frequency interval between 0 and 18 Ghz (in particular 0-30 MHz, first graph; 40-1000 MHz, second graph; and 2-18 GHz, third graph) the shielding effectiveness is never lower than 15 dB (with peaks near to 30 dB between 3 and 7 GHz).

The invention claimed is:

1. Yarns comprising:

textile fibers, either natural or artificial, having a cut length between 60 and 80 mm, and define a cross-sectional diameter between 0.1 and 2; and metallic fibers of iron or its alloys, said metallic fibers having a cut length between 30 and 60 mm, and define a cross-sectional diameter between 0.1 and 1 mm.

2. Yarns according claim 1 comprising between 2 and 15% in said metallic fibers and 98-85% in said textile fibers.

3. Fabrics comprising said yarns according to claim 1 in which the said yarns are comprised both in the weave and in the warp of the same fabric.

4. Fabrics according claim 3 in which the distance between the threads (both in the weave and in the warp) is between 0.1 and 3 mm.

5. Fabrics according to claim 4 consisting of polyester (90%) and stainless steel (10%) fibers.

6. Use of fabrics according to claim 3 for manufacturing goods for the protection against electromagnetic pollution and for location through radar exploration.

7. Use according to claim 6 in which the said goods are suitable for decoration of rooms.

8. Use according to claim 6 in which the said goods are clothes.

9. Use of the fabrics according to claim 3 for the manufacturing of goods suitable to be used in water.

10. Buoys, lifeboats, life-jackets and similar goods comprising or covered by fabrics according to claim 3.

* * * * *